US008936329B2

(12) United States Patent
Kuo

(10) Patent No.: US 8,936,329 B2
(45) Date of Patent: Jan. 20, 2015

(54) CABINET WITH A ROLL DOOR

(75) Inventor: Szu-Wei Kuo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 111 days.

(21) Appl. No.: 13/556,229

(22) Filed: Jul. 24, 2012

(65) Prior Publication Data

US 2014/0009050 A1 Jan. 9, 2014

(30) Foreign Application Priority Data

Jul. 6, 2012 (TW) ..... 101124550 A

(51) Int. Cl.
*E06B 9/15* (2006.01)
*E04F 10/00* (2006.01)
*E06B 9/00* (2006.01)

(52) U.S. Cl.
USPC ..... 312/297; 160/37

(58) Field of Classification Search
CPC ..... E06B 9/115; A47B 96/00; A47B 43/00; A47B 81/00
USPC ..... 312/297, 260, 139.2, 349, 350; 160/37, 160/201, 238, 300; 292/DIG. 36, DIG. 63
See application file for complete search history.

(56) References Cited

U.S. PATENT DOCUMENTS 1,958,695 A * 5/1934 Claus ..... 160/23.1
2,105,783 A * 1/1938 Gersten ..... 160/267.1
2,172,956 A * 9/1939 Derman ..... 312/260
2,200,329 A * 5/1940 Derman ..... 312/260
2,206,767 A * 7/1940 Derman ..... 312/260
3,068,937 A * 12/1962 Christensen ..... 160/41
3,196,935 A * 7/1965 Christensen ..... 160/267.1
4,217,012 A * 8/1980 Klaus ..... 312/292
4,279,454 A * 7/1981 Koiso et al. ..... 312/297
4,441,768 A * 4/1984 Clarkson ..... 312/257.1
4,681,379 A * 7/1987 Pillinini ..... 312/297
4,930,563 A * 6/1990 Finch et al. ..... 160/271
5,246,054 A * 9/1993 Shepherd et al. ..... 160/133
5,372,175 A * 12/1994 Calhoun et al. ..... 160/235
5,474,117 A * 12/1995 Henkenjohann ..... 160/133
5,601,133 A * 2/1997 Krupke et al. ..... 160/265
6,082,432 A * 7/2000 Kissinger ..... 160/290.1
6,422,672 B1 * 7/2002 Searer ..... 312/297
6,478,070 B2 * 11/2002 Poppema ..... 160/23.1
6,655,444 B2 * 12/2003 Goldenberg et al. ..... 160/405
6,814,127 B2 * 11/2004 Tagtow et al. ..... 160/31

(Continued)

FOREIGN PATENT DOCUMENTS

WO WO 2007036265 A1 * 4/2007 ..... E06B 9/15

*Primary Examiner* — Darnell Jayne
*Assistant Examiner* — Kimberley S Wright
(74) *Attorney, Agent, or Firm* — Novak Druce Connolly Bove + Quigg LLP

(57) ABSTRACT

A cabinet includes a top wall, a bottom wall, two opposite sidewalls, and a roll door apparatus mounted between the top and bottom walls and positioned adjacent to one of the sidewalls. The top and bottom walls each define a slide slot perpendicular to the sidewalls and a number of cutouts communicating with the corresponding slide slot. The roll door apparatus includes a rotatable pole, a roll door rolled about the pole and fixed to the pole by a first end, a locking member mounted to a second end of the roll door opposite to the first end. The locking member includes a sliding portion top and bottom ends of which to be slidably received in one of the slide slots, and an engaging portion engaged in two of the cutouts of the top and bottom walls.

13 Claims, 8 Drawing Sheets

(56) References Cited

U.S. PATENT DOCUMENTS

| | | | | |
|---|---|---|---|---|
| 7,219,709 | B1 * | 5/2007 | Williams | 160/24 |
| 7,311,131 | B2 * | 12/2007 | Nien et al. | 160/121.1 |
| 7,395,850 | B2 * | 7/2008 | Chino et al. | 160/243 |
| 7,438,111 | B2 * | 10/2008 | Grimes et al. | 160/23.1 |
| 8,191,604 | B2 * | 6/2012 | Wang | 160/296 |
| 2002/0092628 | A1 * | 7/2002 | Todd | 160/309 |
| 2003/0221796 | A1 * | 12/2003 | Schaller, Jr. | 160/133 |
| 2003/0221797 | A1 * | 12/2003 | Schaller, Jr. | 160/133 |
| 2003/0222554 | A1 * | 12/2003 | Wang | 312/297 |
| 2005/0274462 | A1 * | 12/2005 | Nyffenegger et al. | 160/23.1 |
| 2007/0068635 | A1 * | 3/2007 | Nicolosi | 160/98 |
| 2007/0284053 | A1 * | 12/2007 | Mullet et al. | 160/31 |
| 2010/0307700 | A1 * | 12/2010 | Wang | 160/264 |
| 2013/0048231 | A1 * | 2/2013 | Miller | 160/133 |
| 2013/0319624 | A1 * | 12/2013 | Cannaverde | 160/405 |

* cited by examiner

CABINET WITH A ROLL DOOR

CROSS-REFERENCE TO RELATED APPLICATION

Relevant subject matter is disclosed in a pending U.S. patent application, titled "CABINET WITH A ROLL DOOR," filed on Jul. 20, 2012, with the application Ser. No. 13/554,114, which is assigned to the same assignee as this patent application.

BACKGROUND

1. Technical Field

The present disclosure relates to a cabinet.

2. Description of Related Art

Doors of cabinets are generally made of armor plates which is heavy and mounted to the cabinets with bolts, which is difficult and time-consuming. Furthermore, if opening a cabinet, the door of the cabinet is generally rotated about one of the sidewalls of the cabinet, so that a space for the doors rotation needs to be provided, which wastes space.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
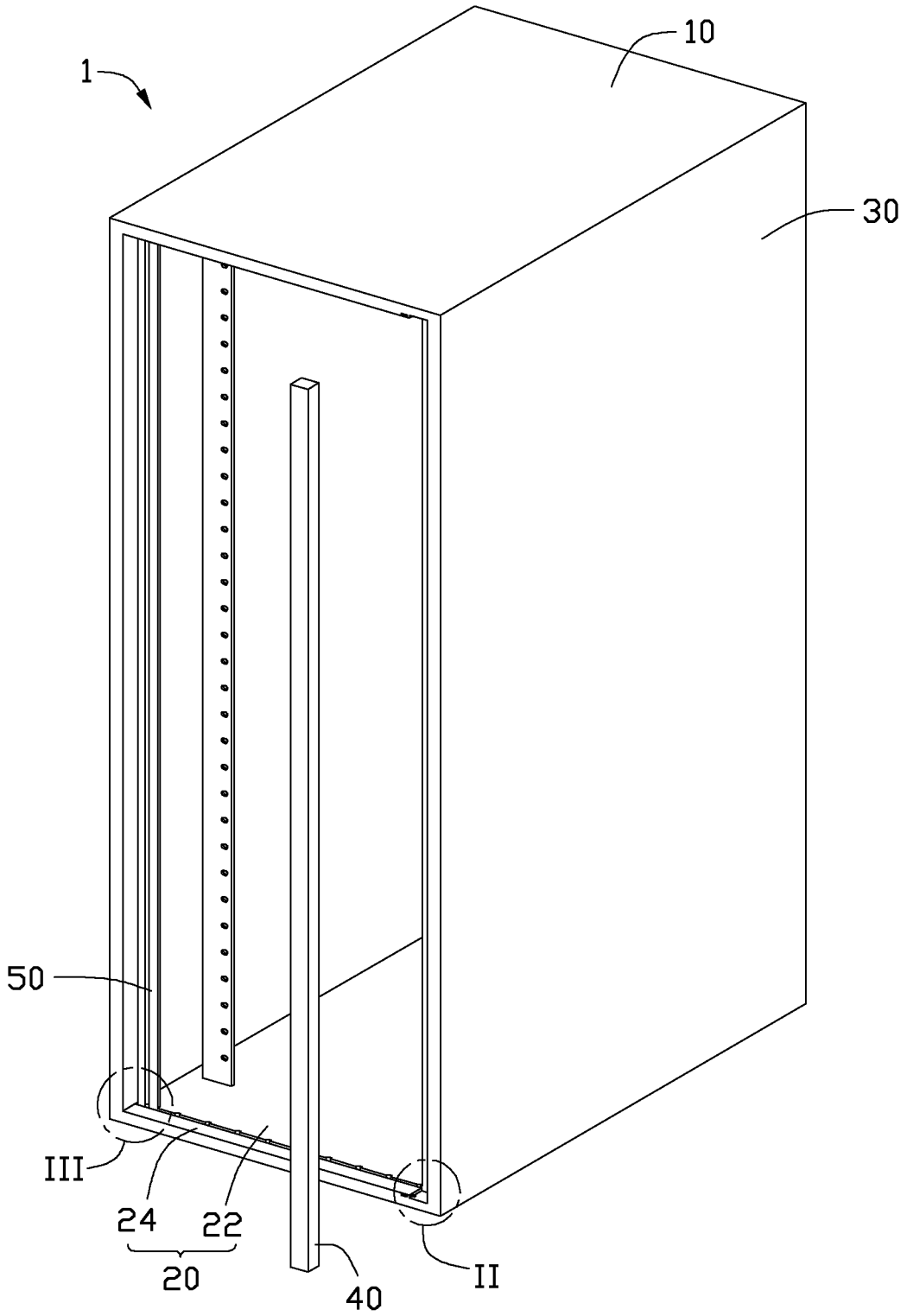
FIG. 1 is an exploded, isometric view of an exemplary embodiment of a cabinet including a roll door apparatus.
Figure 2:
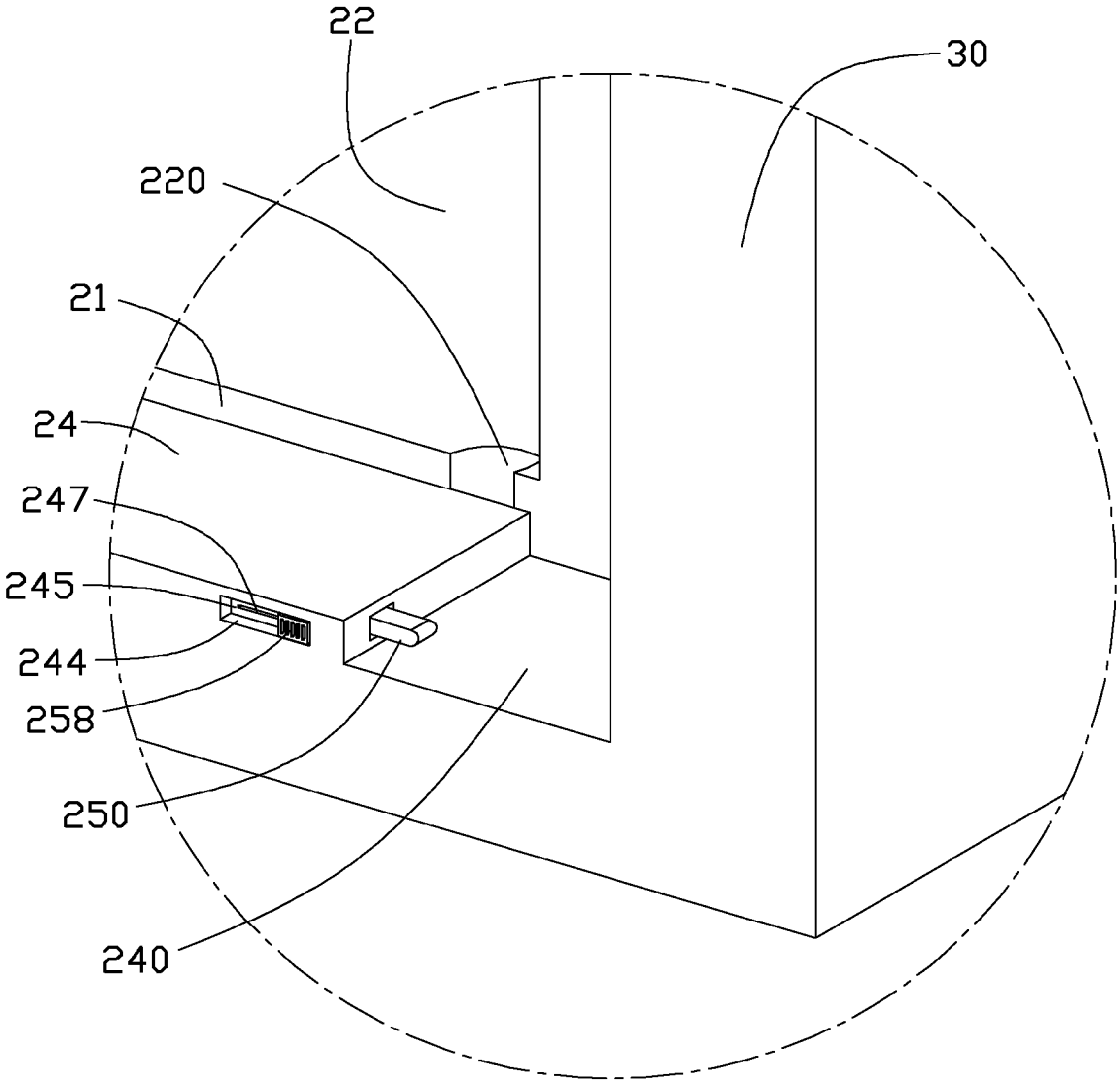
FIG. 2 is an enlarged view of the circled portion II of FIG. 1.
Figure 3:
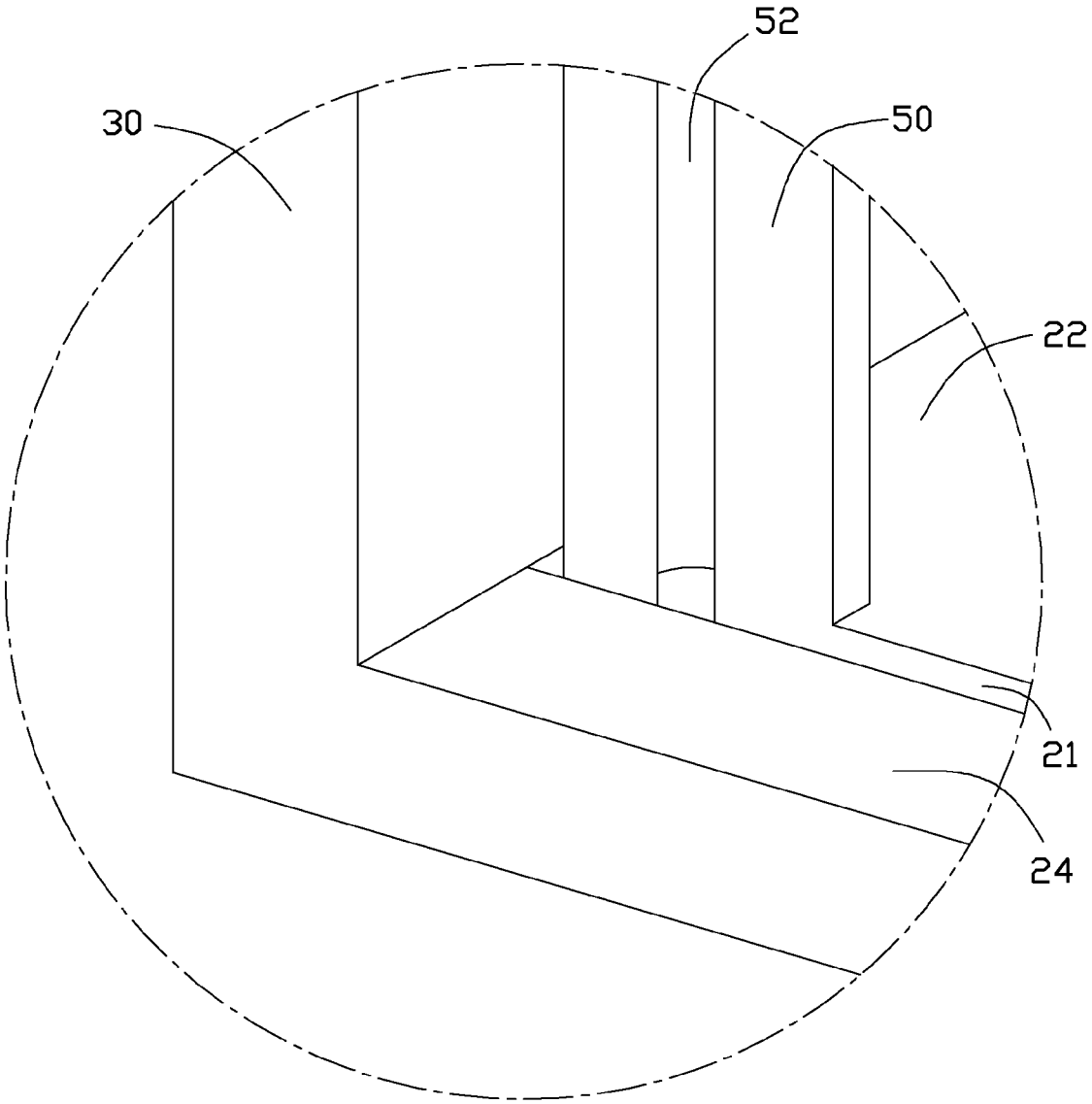
FIG. 3 is an enlarged view of the circled portion III of FIG. 1.
Figure 4:
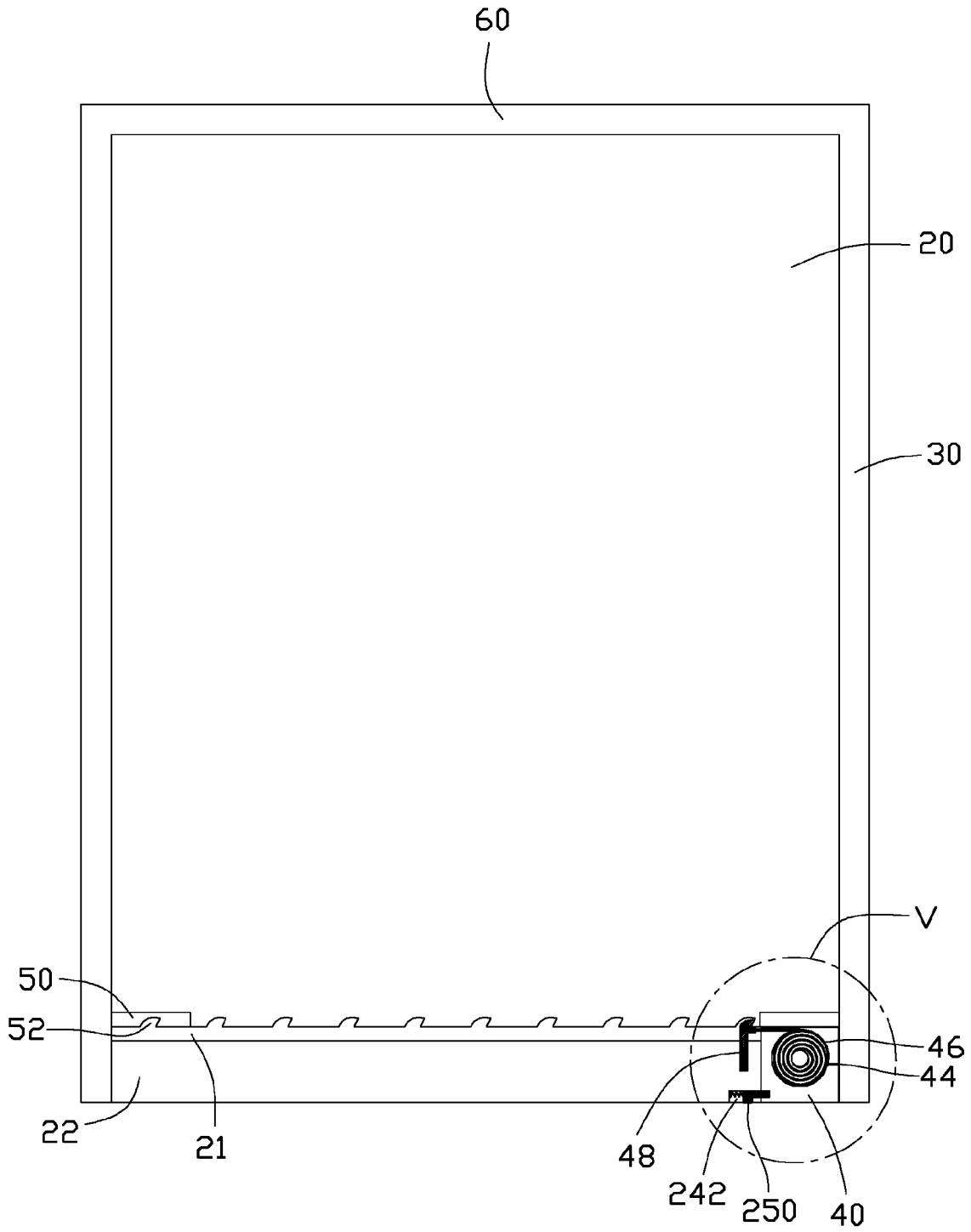
FIG. 4 is a top plan view showing the roll door apparatus mounted to the cabinet.
Figure 5:
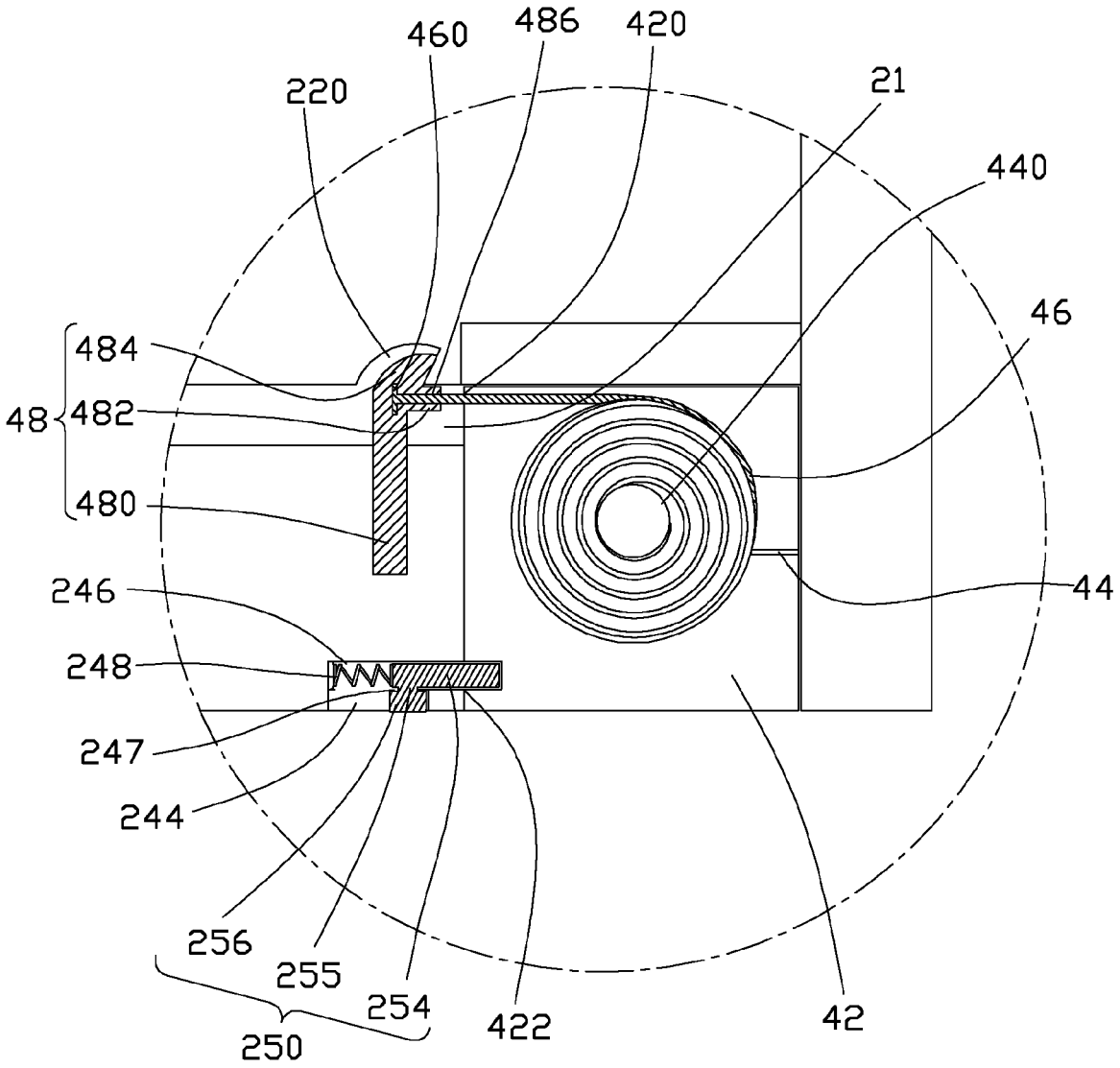
FIG. 5 is an enlarged view of the circled portion V of FIG. 4.
Figure 6:
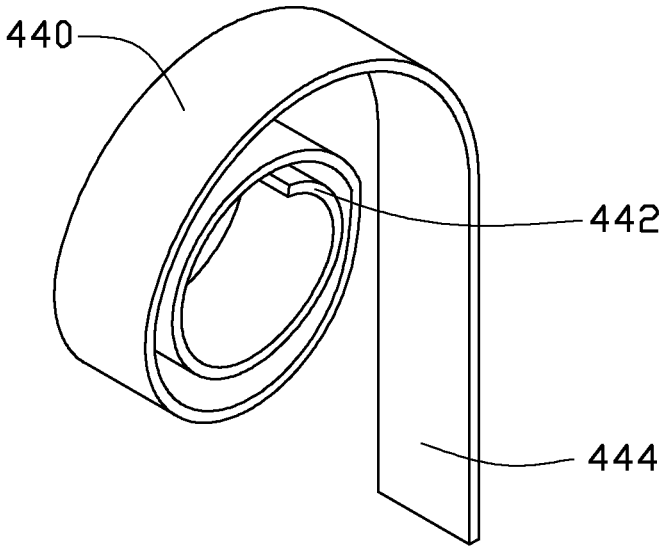
FIG. 6 is an isometric view of a clockwork spring of the roll door apparatus of FIG. 4.

FIGS. 1 and 2 illustrate an exemplary embodiment of a cabinet 1. The cabinet 1 includes a top wall 10, a bottom wall 20, two opposite sidewalls 30 perpendicularly connected between opposite sides of the top and bottom walls 10 and 20, a rear wall 60 (shown in FIG. 4) perpendicularly connected between rear ends of the top and bottom walls 10 and 20, a roll door apparatus 40, and a plate 50.

The bottom wall 20 defines a slide slot 21 perpendicular to the sidewalls 30 in a front end of the bottom wall 20. The slide slot 21 divides the bottom wall 20 into a main portion 22 and an extension portion 24 in front of the main portion 22. The main portion 22 defines a plurality of cuneiform cutout 220 communicating with the slide slot 21.

Referring to FIGS. 1 to 6, the extension portion 24 defines a depressed portion 240 adjacent to one of the sidewalls 30. The depressed portion 240 extends through a front surface of the extension portion 24 and communicates with the slide slot 21. The extension portion 24 defines a receiving hole 242 adjacent to the depressed potion 240. The receiving hole 242 includes a first hole 246 extending through a side bounding the depressed portion 240, a second hole 244 extending through the front surface of the extension portion 24, and a third hole 247 defined in a clapboard 245 dividing the second hole 244 from the first hole 246 and communicating with the first and second holes 246 and 244. A resilient member 248 and a fixing member 250 fixed to a first end of the resilient member 248 are received in the receiving hole 242. A second end of the resilient member 248 opposite to the fixing member 250 is fixed to an inner surface of the first hole 246 opposite to the depressed portion 240. The fixing member 250 includes a movable bar 254 received in the first hole 246, an operation portion 256 slidably received in the second hole 244, and a neck 255 connected between the bar 254 and the operation portion 256 and slidably received in the third hole 247. An antiskid portion 258 is formed on a front surface of the operation portion 256. The first end of the resilient member 248 is fixed to an end of the bar 254 away from the depressed portion 242. In this embodiment, the resilient member 248 is a spring. In other embodiments, the resilient member 248 may be other resilient stuffs, such as rubber.

The top wall 10 has a same form as the bottom wall 20.

The plate 50 perpendicularly extends from a front end of the other sidewall 30 opposite to the depressed portions 242 of the top wall 10 and the bottom wall 20 and connected between front ends of the main portions 22 of the top wall 10 and the bottom wall 20. An engaging slot 52 communicating with the slide slots 21 of the top wall 10 and the bottom wall 20 is defined in a front surface of the plate 50 from top to bottom. The engaging slot 52 has a cuneiform cross-section.

The roll door apparatus 40 includes a hollow receiving member 42, a pole 44 rotatably received in the receiving member 42, a roll door 46 roll about the pole 44, and a locking member 48. The receiving member 42 defines an opening 420 from top to bottom in a rear side of a sidewall of the receiving member 42 facing the receiving hole 242, and two engaging holes 422 defined in top and bottom ends of a font side of the sidewall of the receiving member 42. The engaging holes 422 respectively align with the first holes 246 of the top wall 10 and the bottom wall 20. The roll door 46 extends into or out of the receiving member 32 through the opening 420. The pole 44 is fitted about two clockwork springs 440 respectively at opposite ends of the pole 44. Each clockwork spring 440 has an inner end 442 mounted to the pole 44, and an outer end 444 mounted to an inner surface of the receiving member 42. The roll door 46 has a first end mounted to the pole 44. The roll door 46 rolls about the pole 44. A T-shaped inserting portion 460 extends out from a second end of the roll door 46 opposite the first end. The locking member 48 includes a sliding portion 482, a handle 480 formed at a front side of the sliding portion 482, and an engaging portion 484 formed at a rear side of the sliding portion 482 opposite to the handle 480 and having a cuneiform cross-section. Top and bottom ends of the sliding portion 482 protrude from top and bottom ends of the handle 480, respectively. The sliding portion 482 defines a T-shaped latching slot 486 extending through the top end of the sliding portion 482. The inserting portion 460 is inserted into the latching slot 484, thereby fixing the locking member 48 to the second end of the roll door 46. Because the pole 44 is fitted about the clockwork springs 440, the roll door 46 is capable of automatically being reeled about the pole 44 to be received in the receiving member 42. The roll door 46 defines a plurality of vents 462.

Figure 7:
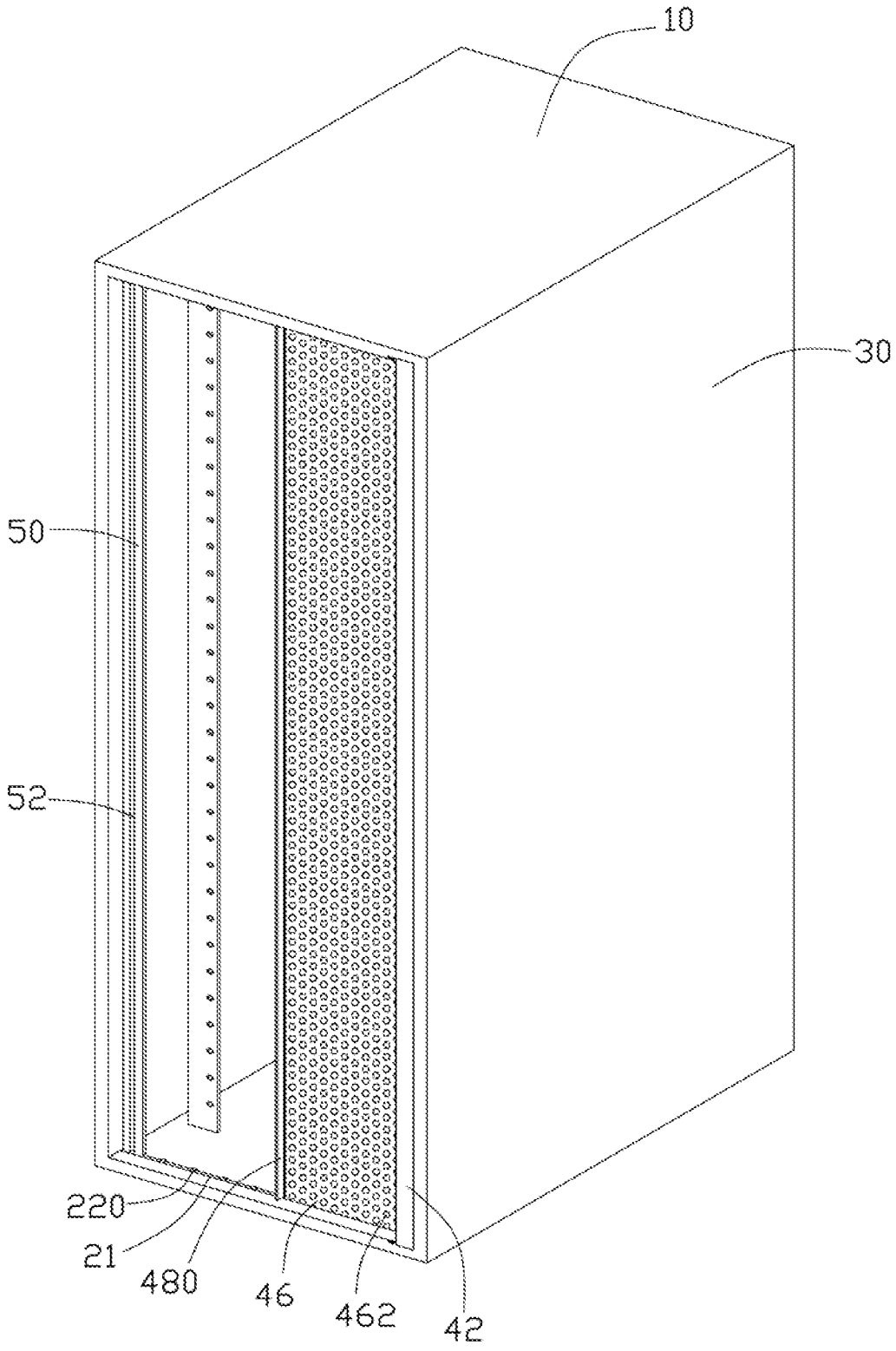
FIG. 7 is an assembled, isometric view of FIG. 1.
Figure 8:
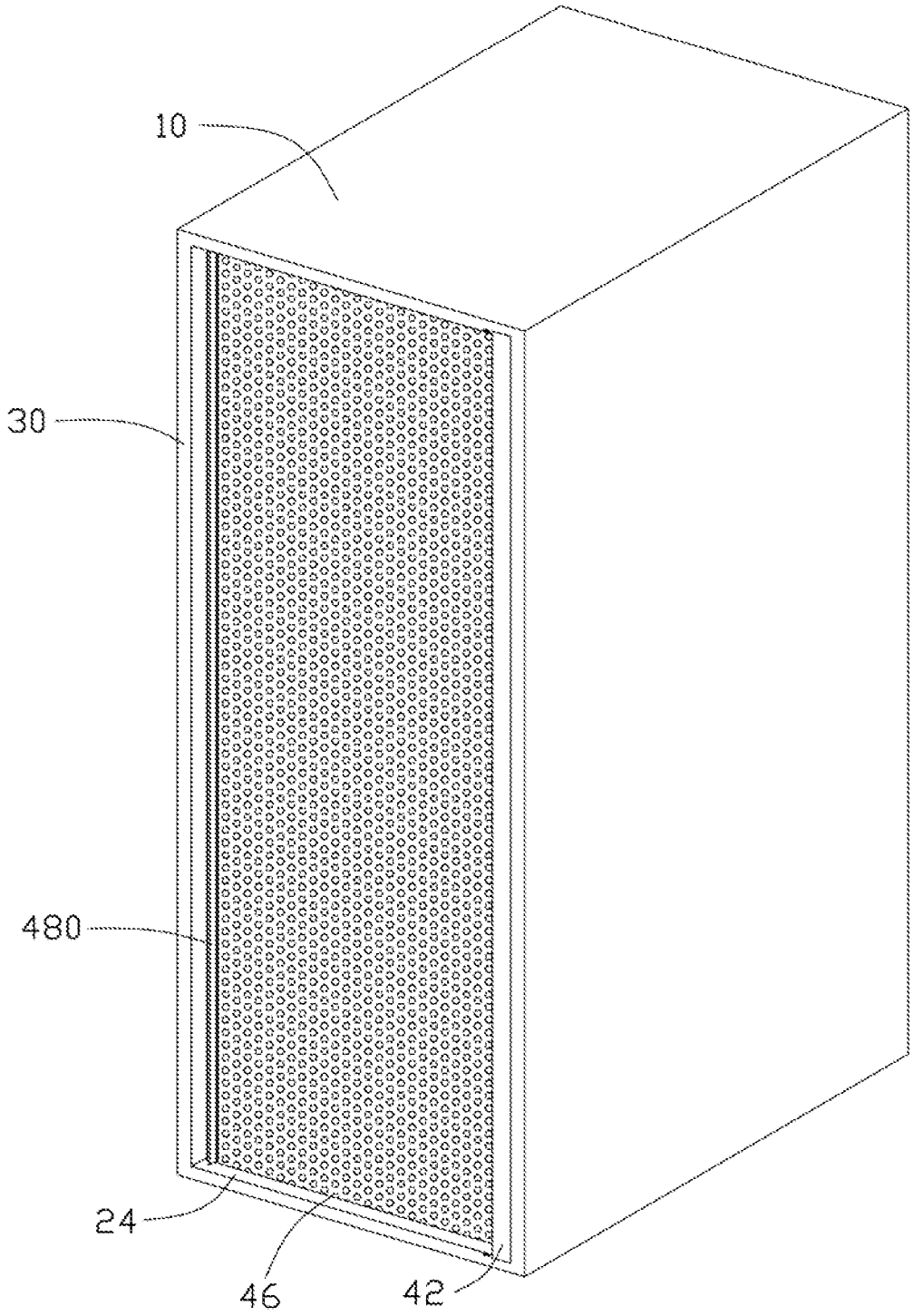
FIG. 8 is similar to FIG. 7, but shows another use state.

Referring to FIGS. 7 and 8, in assembly, the operation portions 256 are moved toward the plate 50, thereby withdrawing the bars 254 into the corresponding first holes 246. The resilient members 248 are deformed. Top and bottom ends of the receiving member 42 are received in the depressed portions 240 of the top wall 10 and the bottom wall 20, respectively. The operation portions 256 are then released, and the resilient members 248 are restored to resist the bars 254 to move out of the corresponding first holes 246 and engage in the corresponding engaging holes 422. Therefore, the receiving member 42 with the roll door 46 is fixed in the depressed portions 240. The handle 480 is pulled toward the plate 50. Top and bottom ends of the sliding portion 482 are slidably received in the slide slots 21, respectively. Top and bottom ends of the engaging portion 484 are engaged in the corresponding cutouts 220.

In use, the handle 480 is slid toward the plate 50 and forward, to disengage the engaging portion 484 from the cutouts 220. The handle 480 is then slid toward the plate 50, to pull the roll door 46 out of the receiving member 42. The clockwork springs 440 are deformed. When the cabinet is needed to be partly closed, opposite ends of the engaging portion 484 are correspondingly engaged in two corresponding cutouts 220 to fix the roll door 46 in a certain place, such as a middle place shown in FIG. 7. When the cabinet is needed to be closed completely, the engaging portion 484 is engaged in the engaging slot 52.

In opening the cabinet 1, the handle 480 is slid away from the depressed portion 240 and forward, to disengage the engaging portion 484 from the corresponding cutouts 220 or the engaging slot 52. The handle 480 is then released, the clockwork springs 440 are restored; thereby the roll door 46 automatically rolled about the pole 44.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A cabinet, comprising:

a first sidewall;

a second sidewall opposite to the first sidewall;

a bottom wall connected between bottoms of the first and second sidewalls, and defining a slide slot perpendicular to the first and second sidewalls, and a plurality of cutouts communicating with the slide slot;

a top wall connected between tops of the first and second sidewalls, and defining a slide slot perpendicular to the first and second sidewalls, and a plurality of cutouts communicating with the slide slot of the top wall; and a roll door apparatus mounted between the top and bottom walls and adjacent to the first sidewall; the roll door apparatus comprising a rotatable pole, a roll door capable of reeled about the pole and fixed to the pole with a first end, a locking member fixed to a second end of the roll door opposite to the first end; the locking member comprising a sliding portion top and bottom ends of which slidably received in the corresponding slide slots, and an engaging portion selectively engaged in two of the cutouts of the top and bottom walls;

wherein a depressed portion is defined in each of the top and bottom walls and adjacent to the first sidewall, each depressed portion communicates with a corresponding one of the slide slots, the roll door apparatus comprises a receiving member receiving the pole and the roll door, top and bottom ends of the receiving member are located in the corresponding depressed portions, the receiving member defines an opening from top to bottom, the roll door capable of extending out of or into the receiving member through the opening;

wherein a receiving hole is defined in each of the top wall and bottom wall adjacent to a corresponding depressed portion, each receiving hole contains a fixing member, the fixing member is capable of extending out of the receiving hole into the corresponding depressed portion and fixing a corresponding one of the top and bottom ends of the receiving member in the corresponding depressed portion.

2. The cabinet of claim 1, wherein each receiving hole comprises a first hole, each fixing member comprises a bar movably received in the first hole of the corresponding receiving hole, the receiving member defines two engaging holes respectively aligning with the first holes of the corresponding receiving holes, the bars capable of extending out of the corresponding first holes and engaging in the corresponding engaging holes.

3. The cabinet of claim 2, wherein each fixing member further comprises a resilient member received in the corresponding first hole and connected between the bar and a sidewall bounding the first hole opposite to the depressed portion.

4. The cabinet of claim 2, wherein each receiving hole further comprises a second hole, each fixing member further comprises an operation portion slidably received in the corresponding second hole.

5. The cabinet of claim 4, wherein an antiskid portion is formed on an outer surface of each operation portion.

6. The cabinet of claim 4, wherein each receiving hole further comprises a third hole defined in a clapboard dividing the corresponding second hole from the corresponding first hole and communicating with the corresponding first and second holes, each fixing member further comprises a neck connected between the corresponding bar and the operation portion and slidably received in the corresponding third hole.

7. The cabinet of claim 1, wherein a plate perpendicularly extends from the second sidewall toward the first sidewall, and defines an engaging slot from top to bottom, the engaging portion of the locking member is detachably engaged in the engaging slot.

8. The cabinet of claim 1, wherein a handle is formed on a side of the locking member opposite to the engaging portion.

9. The cabinet of claim 8, wherein the cutouts are located behind the corresponding slide slots.

10. The cabinet of claim 1, wherein the roll door defines a plurality of vents.

11. The cabinet of claim 1, wherein the engaging portion and the cutouts each have a cuneiform cross-section.

12. The cabinet of claim 1, wherein the fixing member defines a T-shaped latching slot from top to bottom, the latching hole extends through the top of the sliding portion, a T-shaped inserting portion extends out from the second end of the roll and inserted into the latching slot.

13. The cabinet of claim 1, wherein the pole is fitted about two clockwork springs each having an inner end mounted to the pole and an outer end mounted to an inner surface of the receiving member.

* * * * *